United States Patent [19]

Alen et al.

[11] Patent Number: 5,032,223

[45] Date of Patent: Jul. 16, 1991

[54] PROCEDURE FOR DETERMINING AND CONTROLLING THE COMPOSITION PROPORTIONS OF WOOD CHIP MIXES IN ALKALINE PULP DIGESTION PROCESSES

[75] Inventors: Raimo Alen, Helsinki; Pasi Hentunen, Espoo; Leena Paavilainen, Kajaani; Eero Sjostrom, Helsinki, all of Finland; Taina Sopenlehto-Pehkonen, Silver Spring, Md.; Olavi Sundstrom, Kajaani, Finland

[73] Assignee: Kajaani Elektroniikka Oy, Finland

[21] Appl. No.: 416,932

[22] Filed: Oct. 4, 1989

Related U.S. Application Data

[63] Continuation-in-part of Ser. No. 269,249, Nov. 9, 1988, abandoned.

[30] Foreign Application Priority Data

Nov. 27, 1987 [FI] Finland ..... 875248

[51] Int. Cl.[5] ..... D21C 3/02; D21C 7/12

[52] U.S. Cl. ..... 162/49; 162/61; 162/62

[58] Field of Search ..... 162/61, 62, 49, 76, 162/DIG. 10, 198, 238

[56] References Cited

U.S. PATENT DOCUMENTS 4,853,084 8/1989 Alen et al. ..... 162/49

FOREIGN PATENT DOCUMENTS 870312 7/1988 Finland .

1044702 9/1983 U.S.S.R. ..... 162/49

*Primary Examiner*—Steve Alvo

*Attorney, Agent, or Firm*—Kane, Dalsimer, Sullivan, Kurucz, Levy, Eisele & Richard

[57] ABSTRACT

A procedure for determining the composition of a wood chip mix dispensed in alkaline delignifying processes, particularly in sulphate and soda/anthraquinone cooking, with the aid of the monomeric compounds produced in connection with the cooking and dissolved in the waste liquor. As taught by the procedure, a cooking liquor sample is taken in the cooking process, this sample being chromatographically analyzed. On the basis of the content proportions of certain compounds analyzed by substance groups, the composition of the dispensed wood chip mix is determined, and at the same time information is gained for optimating the conditions applied in the cooking process.

6 Claims, 3 Drawing Sheets

PROCEDURE FOR DETERMINING AND CONTROLLING THE COMPOSITION PROPORTIONS OF WOOD CHIP MIXES IN ALKALINE PULP DIGESTION PROCESSES

This is a continuation-in-part of application Ser. No. 269,249, filed on Nov. 9, 1988, and now abandoned.

BACKGROUND OF THE INVENTION

The present invention concerns a procedure which is applicable in determining the composition of wood chip mixes dispensed in alkaline wood delignification, particularly in sulphate digestion, by observing the changes in concentration of the decomposition products formed from the wood material by cleaving and dissolved in the cooking liquor.

Wood chip mix is in this connection understood to mean, in the first place, chip mixes consisting of softwood and hardwood. The procedure is applicable both in so-called batch cooking processes and in continuous cooking processes. In the latter case it also becomes possible to observe the shift of the wood species boundary taking place after a change of wood raw material: this affords highly valuable, and frequently indispensable, information needed in order to maintain uniform quality. Since the delignification rates of softwood and hardwood are different, the information gained concerning chip composition contributes substantially to success in endeavours to optimate the process.

In alkaline digestion processes lignin contained in the wood raw material, which binds the cellulose fibres together, is removed under strongly alkaline conditions, whereas also partial decomposition of the polymeric carbohydrate material of the wood (cellulose and hemicelluloses) to aliphatic carboxylic acids takes place at the same time (Sjöström, E., Wood Chemistry; Fundamentals and Applications, Academic Press, New York, 1981). It is thus understood that the organic matter dissolved in the waste liquor is composed not only of lignin decomposition products but also of said carbohydrate decomposition products, and in minor quantity, of wood extractives. The greater part of said decomposition products are present in the form of monomeric compounds which can be analytically separated by means of chromatographic methods.

As taught by earlier patent applications (FI 850208 and FI 870312), corresponding to U.S. Pat. Nos. 4,853,084 and 4,944,841 respectively control of alkaline digestion processes can be implemented, with surprising exactitude, by chromatographically analyzing the relative composition of aliphatic carboxylic acids or lignin monomers contained in the cooking liquor.

SUMMARY OF THE INVENTION

It has now been found, in the procedure of the present invention, that it is furthermore possible on the basis of the decomposition product compositions, i.e. aliphatic carboxylic acids or lignin monomers contained in the cooking liquor, to determine the composition of the mixed softwood and hardwood chips that have been dispensed into the digestion process.

It has been found that in addition to producing the same decomposition products, though at different concentrations, as are obtained in hardwood digestion, delignification of softwood also partially produces entirely different decomposition products. In the present invention a novel and unexpected observation has been made: that in so-called mixed wood digestion the relative quantities of monomers that are produced vary regularly in dependence of the composition of the chips that are dispensed. Said decomposition products may be analyzed during progress of cooking, and it is then possible with the aid of the information that has been gained, to control the cooking conditions as implied by the variations of chip composition and in a way which is optimal in view of the overall digestion performance, and at the same time to achieve uniform pulp. This is essential in view of the quality characteristics of the pulp.

The main characteristic features of the invention are readable in the claims following further below.

While developing the procedure of the invention, detailed analyses had to be made of liquor samples taken during progress of digestion, these samples being obtained by cooking softwood and hardwood chip mixes with known mixing proportions, in laboratory scale tests. The analyses had relation to determinations of concentration of aliphatic carboxylic acids derived from carbohydrates and phenol monomers derived from lignin, but in addition also extractive substances were determined, which furthermore are species-specific to a certain extent. It should however be mentioned that chemical composition and quantity of the extractive substances present in wood material are greatly dependent on the time which the chips are stored. It was clearly evident from the results hereby obtained that in a consideration by groups of substances a certain, consequent connection prevails between the mutually compared concentrations of dissolved compounds (or their proportions) and the chip composition supplied in the cooking process. It was also found that when the samples are taken at an early enough stage (e.g. after the temperature-raising phase), it becomes possible on the basis of the chip composition to facilitate the optimation of the most significant unit operations in pulp manufacturing (i.e., cooking). The procedure was furthermore applied in connection with a continuous, mill-scale sulphate digestion process, in which during the cooking process the shift of the wood species boundary, due to a change of wood species, was followed.

It is a prerequisite for successful application of the procedure that the decomposition products which are formed can be separated and can be analyzed with adequate accuracy. The contents of monomeric carboxylic acids and phenol derivatives are determinable swiftly and accurately enough by chromatographic methods, e.g. by gas chromatography (cf. patent applications FI 850208 and FI 870312 already cited as references in the foregoing), whereby the control information required in the pulping process is immediately obtained by utilizing computer technology.

The aliphatic acids in question are composed, in addition to volatile acids such as formic, acetic, glycolic, lactic, 3-hydroxypropanoic, glyceric, 2-C-methylglyceric, 2-hydroxybutanoic, 4-hydroxybutanoic, 2-deoxytetronic, 3-deoxytetronic, 2-hydroxypentenoic, 2-hydroxypentanoic, 3,4-dideoxypentonic, 3-deoxy-ervth- ro-pentonic, 3-deoxy-threo-pentonic, xyloisosacchrinic, anhydroglucoisosaccharinic, α-glucoisosaccharinic, β-glucoisosaccharinic, α-galactometasaccharinic, β-galactometasaccharinic, 3,4-dideoxy-erythro-hexonic, 3,4-dideoxy-threo-hexonic, 3,6-dideoxy-arabino-hexonic, 3,6-dideoxy-ribo-hexonic, oxalic, tartronic, C-methyltartronic, succinic, malic methylsuccinic, 2-deoxy-3-C-methyltetraric 2,3-dideoxypentaric, 2,4-dideoxypentaric, 3-deoxy-threo-pentaric, 2,3,4-trideoxyhexaric, 3,4-dideoxy-erythro-hexaric, 3,4-dideoxythreo-hexaric, α-glucoisosaccharinaric, β-glucoisosaccharinaric and C-(2,3-dihydroxy-propyl)tartronic acid. Among these, the fraction of 3,4-dideoxypentonic acid is the most significant as to quantity, and it can be analyzed during cooking e.g. by the well-known gas-chromatographic method (Alén, R., Niemelä, K. & Sjöström, E., J. Chromatogr. 301(1984)274). In this method of analysis, the hydroxy acids are distinguished from each other as separately prepared trimethylsilylic derivatives.

According to the invention the relative concentrations of at least two, possibly more than two carboxylic acids, or alternatively their absolute concentrations generated as degradation products of carbohydrates in the course of an alkaline cooking process are analyzed as a function of the known composition, i.e. softwood/-hardwood relationship of the chips used. The current composition proportion of an unknown wood chips mix used is determined on the basis of the concentration relationships, or alternatively absolute quantities of at least two, possibly more than two aliphatic carboxylic acids by comparing them to the corresponding concentration relationships determined in the corresponding cooking conditions.

The phenol monomers in question are composed such as quaiacol, 4-ethylquaiacol, 4-vinylquaiacol, vanillin, trans-isoeugenol, acetovanillone, apocynol, 1-(4-hydroxy-3-methoxyphenyl)-2-propane, 2-(4-hydroxy-3-methoxyphenyl)ethanol, vanillic acid, dihydroconiferyl alcohol, cis-coniferyl alcohol, trans-coniferyl alcohol, syringol, 4-vinylsyringol, syringaldehyde, acetosyringone, 1-(3,5-dimethoxy-4-hydroxyphenyl)-2-propanone, syringic acid, dihydrosinapyl alcohol, allylsyringol, cis-sinapyl alcohol and trans-sinapyl alcohol.

According to the invention the relative concentrations of at least two, possibly more than two phenol monomers, or alternatively their absolute concentrations, generated as degradation product of lignin in the course of an alkaline cooking process, are analyzed as a function of the known composition, i.e. softwood/hardwood relationship of the chips used. The current composition proportion of an unknown wood chips mix used is determined on the basis of the concentration relationships, or alternatively absolute quantities, of at least two, possibly more than two phenol monomers by comparing them to corresponding concentration relationships determined in corresponding conditions.

DETAILED DESCRIPTION OF THE INVENTION

In the following examples, the procedure constituting the object of the invention is more closely illustrated. Although these examples refer to sulphate digestion of pine and birch mixed chips, it goes without saying that the procedure is also applicable in connection with other alkaline digestion processes e.g. soda/anthraquinone cooking, and in the case of other wood species being used for raw material and also to other kinds of cellulosic plant materials, provided that in each instance is first determined the mutually related formation of suitably selected decomposition products, referenced to the composition of the raw material in each particular case.

EXAMPLE 1

Chip mixes made from pine wood (*Pinus sylvestris*) birch wood (*Betula verrucosa / B. pubescens*) were subjected in a laboratory digester to standard sulphate cooking under the following conditions:

| | |
|---|---|
| Effective alkali: (as NaOH) | Birch/Pine (mass proportion) 0/100 to 20/80 19%, 30/70 to 70/30 18%, and 80/20 to 100/0 17% of the wood |
| Sulphidity: | 30% |
| Liquid/wood proportion: | 4 L/kg |

The temperature of the cooking batch was increased at uniform rate during 100 min. from 50° to 150° C. (the cooking was thereafter continued in standard manner by raising the temperature to the actual delignifying temperature, 170° C.), the waste liquors produced during this phase being analyzed. It was noted at the same time that it is advantageous to perform the sampling within the cooking temperature interval from 140° to 170° C. because then the acid proportions selected undergo minor changes only.

Figure 1:
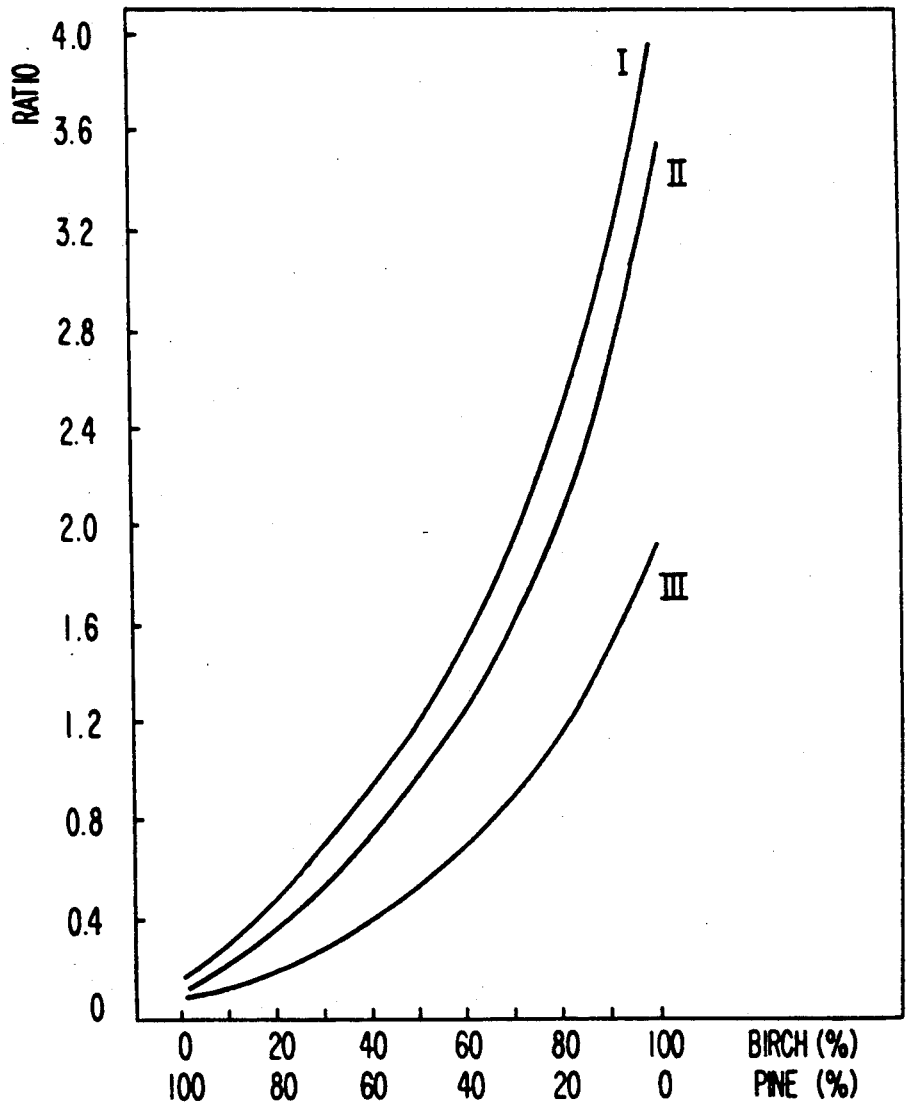
FIG. 1 discloses the proportion, based on relative contents, of aliphatic carboxylic acids produced in a sulphate cooking process, plotted over the mixed pine and birch wood chips dispensed in the cooking process.

In FIG. 1 following acids and their ratios are shown: the acid ratios I (xyloisosaccharic acid)/(3,4-di-deoxy-pentonic acid), II (xyloisosacchraric acid)/(α-glucoisosaccharic acid), and III (2-hydroxybutanic acid xyloisosaccharic acid)/(α-glucoisosaccharic acid +β-glucoisosaccharic acid) as a function of the chip composition. Said acid ratios are based on the contents of selected acid derivatives analyzed as taught by the patent application FI 850208, in each case, as a function of the chip composition supplied to the cooking process. As a consequence of the sensitive way in which the ratios here depicted change with changing chip composition, the results may be applied with high accuracy in analyzing any of the ratios of the curves in same kind of cooking process and determining the composition of an unknown chip mix on a curve of FIG. 1.

EXAMPLE 2

Figure 2:
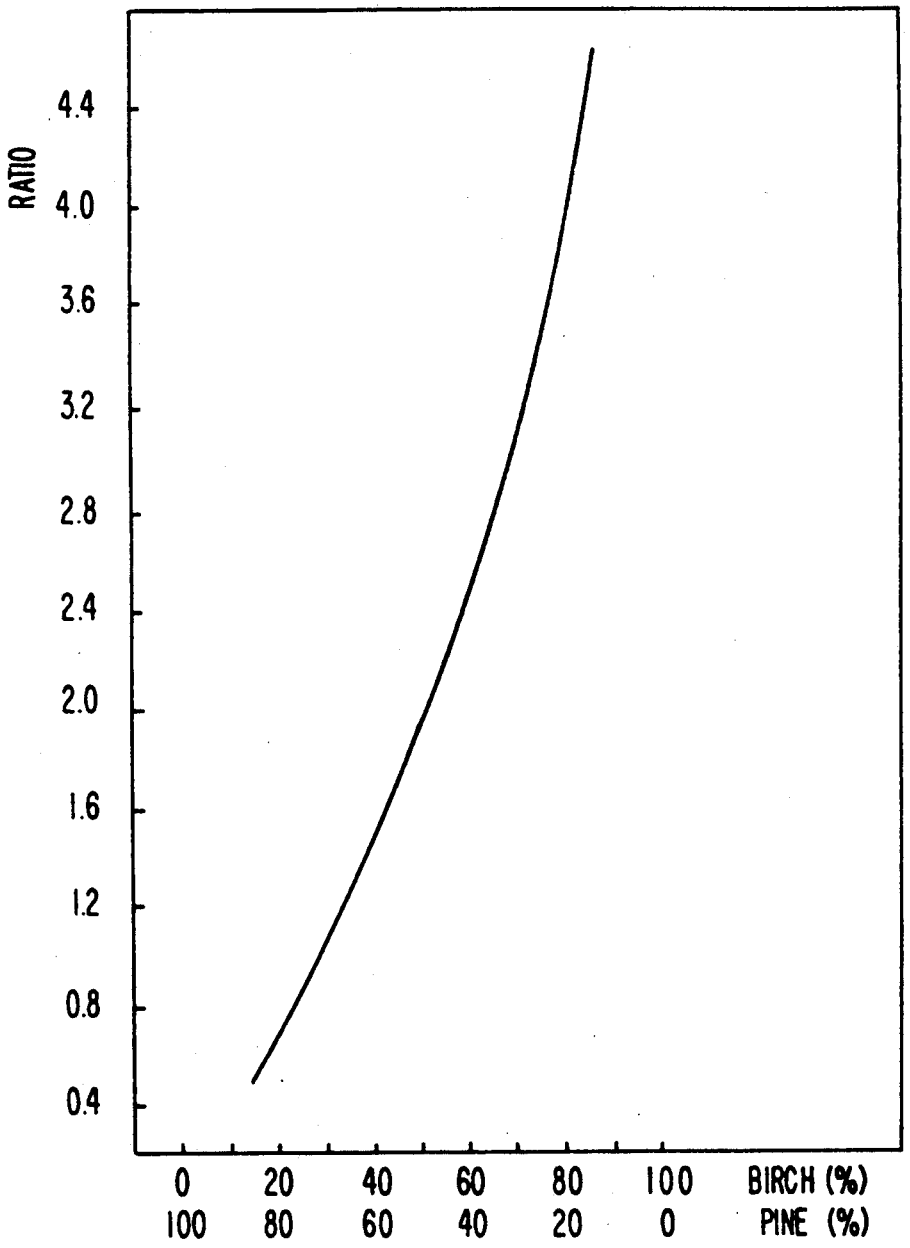
FIG. 2 discloses the content proportion of lignin monomers produced in a sulphate cooking process, plotted over the mixed pine and birch wood chips dispensed in the cooking process, and FIG. 3 discloses the shift of the wood species boundary in a continuous sulphate cooking process, determined with the aid of the procedure.

From the respective waste liquor samples of cooking runs as in Example 1, the ratio of the lignin monomers (diconiferylalcohol)/(vanillic acid) was analyzed. The monomers were analyzed as taught by the patent application FI 870312. In FIG. 2 is shown an example of a ratio of contents which is usable in view of determining the chip mix composition. In this case, too, the result can be usefully applied with high accuracy in analyzing said ratio in same kind of cooking process and determining the composition of an unknown chip mix on the curve of FIG. 2, owing to the rather significant change, related to variations of chip mix composition.

EXAMPLE 3

Figure 3:
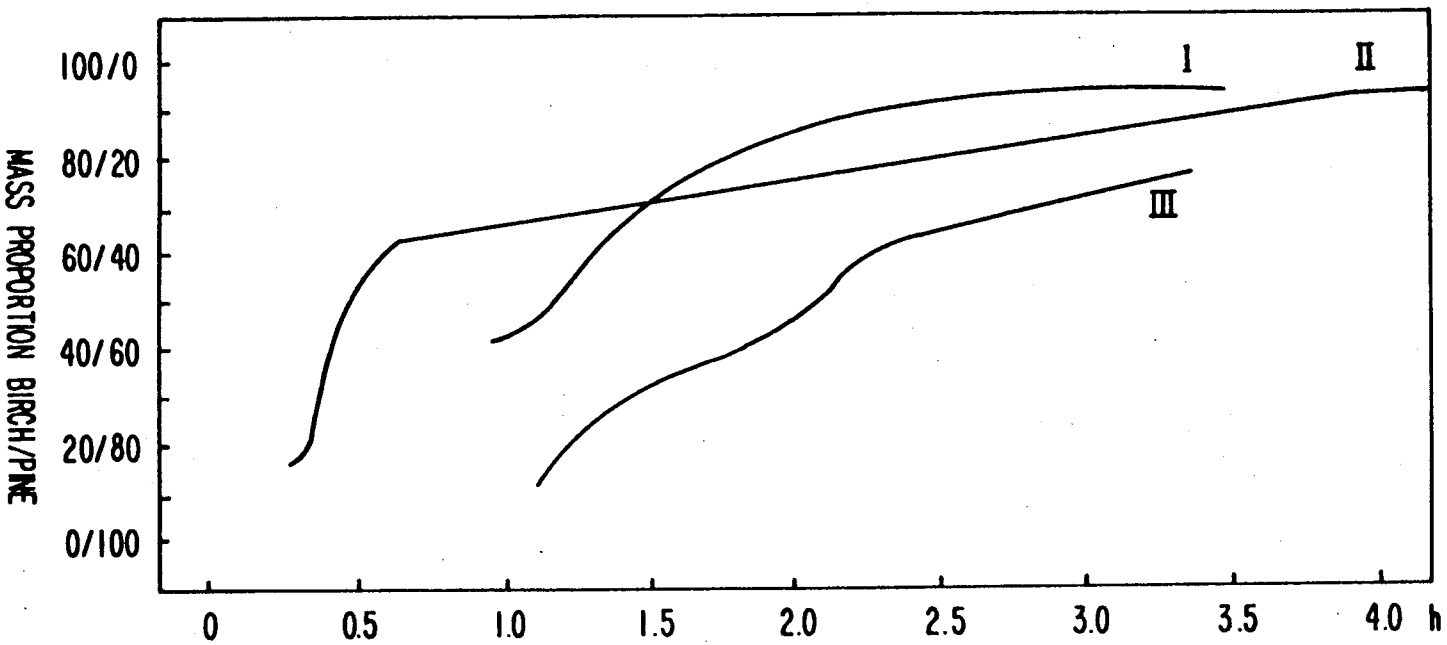

With the aid of the results obtained in the foregoing Examples 1 and 2, the wood species boundary shift was observed in a continuous sulphate process by taking samples from the feed, equalizing and interruption circuits of the digester, FIG. 3: I equalizing circuit, II feed circuit, and III interruption circuit. The results obtained in the case of the feed and interruption circuits of the digester were only little different, and the movement of the desired wood species limiting ratio e.g. 50/50 could be determined on the curves of FIG. 3 with an accuracy of 2–4 min.

Thus the results aid substantially the maintaining of objective values which are optimal in view of the digester's operation.

We claim:

1. A procedure for monitoring the composition proportion of hardwood and softwood chip mixes used in the dispensing in an alkaline delignifying cooking process, comprised or determining the composition proportions of at least two decomposition products produced from the hardwood and softwood material and dissolved in the cooking liquor and selected from the group consisting of aliphatic carboxylic acids derived from carbohydrates and phenol monomers derived from lignin by determining the concentrations of the decomposition products and then determining the composition proportion of hardwood and softwood chips by comparing said determined two decomposition products concentrations to corresponding concentrations of known hardwood and softwood chip mixes in corresponding cooking conditions controlling the cooking conditions from the determined composition proportion of hardwood and softwood chips to produce a uniform pulp.

2. Procedure according to claim 1, wherein the wood substance-specific decomposition products present in the cooking liquor are separated and analyzed by substance groups using a chromatographic method.

3. Procedure according to claim 1, wherein the monomer compounds present in the cooking liquor are analyzed in the form of derivatives by gas chromatography, utilizing a capillary column.

4. Procedure according to claim 1, wherein the composition of the wood chip mix is determined on the basis of the proportions of content of at least two phenolic monomer compounds occurring in the cooking liquor, said proportions being compared with separately determined equivalent proportions produced in each cooking application with various wood chip compositions.

5. A procedure according to claim 1, wherein the decomposition products are monocarboxylic acids selected from the group consisting of formic, acetic, glycolic, lactic, 3-hydroxypropanoic, glyceric, 2-o-methylglyceric, 2-hydroxybutanoic, 4-hydroxybutanoic, 2-deoxytetronic, 3-deoxytetronic, 2-hydroxypentenoic, 2-hydroxypentanoic, 3,4-dideoxypentonic, 3-deoxy-erythro-pentonic, 3-deoxy-threo-pentonic, xyloisosaccharinic, anhydroglucoisosaccharinic, α-glucoisosaccharinic, β-glucoisosaccharinic, α-galactometasaccharinic, βgalactometasaccharinic, 3,4-dideoxy-erythro-hexonic, 3,4-dideoxy-threo-hexonic, 3,6-dideoxy-arabino-hexonic, 3,6-dideoxy-ribo-hexonic, oxalic, tartronic, C-methyltartronic, succinic, malic methylsuccinic, 2-deoxy-3-C-methyltetraric 2,3-dideoxypentaric, 2,4-dideoxypentaric, 3-deoxy-treo-pentaric, 2,3,4-trideoxyhexaric, 3,4-dideoxy-erythro-hexaric, 3,4-dideoxy-threo-hexaric, α-glucoisosaccharinaric, β-glucoisosaccharinaric, β-glucoisosaccharinaric and C-(2,3-dihydroxypropyl)tartronic acid.

6. A procedure according to claim 1 wherein the decomposition products are phenolic monomers selected from the group consisting of quaiacol, 4-ethylquaiacol, 4-vinylquaiacol, vanillin, trans-esoeugenol, acetovanillone, apocynol, 1-(4-hydroxy-3-methoxyphenyl)-2-propane, 2-(4-hydroxy-3-methoxyphenyl)ethanol, vanillic acid, dihydroconiferyl alcohol, cis-coniferyl alcohol, trans-coniferyl alcohol, syringol, 4-vinylsyringol, syringaldehyde, acetosyringone, 1-(3,5-dimethoxy-4-hydroxyphenyl)-2-propanone, syringic acid, dihydrosinapyl alcohol, allylsyringol, cis-sinapyl alcohol and trans-sinapyl alcohol.

* * * * *